United States Patent [19]

Keim

[11] 4,274,699

[45] Jun. 23, 1981

[54] PRESS FIT TERMINAL WITH SPRING ARM CONTACT FOR EDGECARD CONNECTOR

[75] Inventor: Kenneth J. Keim, Lewisberry, Pa.

[73] Assignee: E. I. Du Pont De Nemours and Company, Wilmington, Del.

[21] Appl. No.: 82,552

[22] Filed: Oct. 9, 1979

Related U.S. Application Data

[63] Continuation-in-part of Ser. No. 900,486, Apr. 27, 1978, abandoned.

[51] Int. Cl.[3] ..... H01R 13/40

[52] U.S. Cl. ..... 339/176 MP; 339/220 R

[58] Field of Search ..... 339/220, 221, 176 MP

[56] References Cited

U.S. PATENT DOCUMENTS

| | | | |
|---|---|---|---|
| 3,172,718 | 3/1965 | Lalonde | 339/176 MP |
| 3,328,749 | 6/1967 | Kukla | 339/221 R |
| 3,348,191 | 10/1967 | Kinkaid | 339/220 R |
| 3,634,819 | 1/1972 | Evans | 339/252 P |
| 3,671,917 | 6/1972 | Ammon et al. | 339/176 MP |
| 3,710,303 | 1/1973 | Gallager, Jr. | 339/176 MP |
| 3,783,433 | 1/1974 | Kurtz et al. | 339/17 C |
| 3,824,554 | 7/1974 | Shoholm | 339/221 R |
| 3,827,004 | 7/1974 | Vanden Heuvel et al. | 339/221 R |
| 3,963,293 | 6/1976 | McKee | 339/17 L |
| 3,997,237 | 12/1976 | White | 339/221 R |
| 4,057,315 | 11/1977 | Miller et al. | 339/221 R |
| 4,066,326 | 1/1978 | Lovendusky | 339/221 M |
| 4,077,694 | 3/1978 | Cobaugh et al. | 339/176 MP |

FOREIGN PATENT DOCUMENTS 1505895 3/1978 United Kingdom .

*Primary Examiner*—Neil Abrams

[57] ABSTRACT

An elongated electrical terminal with a deformed mounting portion adapted to be press fit into a circuit board aperture in an edgecard connector. The mounting portion is a generally cylindrical body with symmetrically opposed oval shaped voids extending lengthwise therein. The terminal has contacts at both ends; one of the contacts is a spring arm, the other is a wire wrap tail. The spring arm has a free end parallel to, but off-set from the axis of the wire wrap tail. A plurality of such terminals are press fit into apertures in a supporting circuit board. An insulative connector housing adapted to receive a mating circuit board fits over the spring arm contacts and mates with the supporting circuit board to form an edgecard connector. The housing has an inside wall which restricts the free ends of the spring arms to movement only along a plane parallel to the axis of the tail of an inserted terminal, so as to insure electrical connection between the spring arms and the mating board when the latter is inserted into the connector.

8 Claims, 10 Drawing Figures

PRESS FIT TERMINAL WITH SPRING ARM CONTACT FOR EDGECARD CONNECTOR

This application is a continuation in part of my prior application Ser. No. 900,486 filed Apr. 27, 1978 (now abandoned).

DESCRIPTION

1. Technical Field

This invention relates to a new electrical terminal for an edgecard connector for use in the electrical connector industry, particularly in micro-circuits technology involving multiple circuit board terminations. More particularly, this invention relates to the manufacture and use of connectors having elongated terminals which are press fit into circuit board apertures and which have spring arm contacts adapted for receiving and making electrical contact with circuit boards.

2. Background Art

In the use of terminals for micro-circuit applications there is an ever-present need for structures which are inexpensive to manufacture, yet which possess inherently high degrees of reliability. In the manufacture of press fit terminals for mounting in circuit board apertures, care must be exercised to insure that tolerances between the board apertures and the mounting portions of the terminals are within certain pre-set limits. The limits must be adequate to insure sufficient retention force, and yet avoid injury to metallization plating in the aperture. Many structures have been proposed for achievement of this objective without substantial sacrifice in manufacturing costs and reliability of the terminations effected thereby.

For example, U.S. Pat. No. 4,066,326, issued to Lovendusky, discloses a circuit board contact with an expanded mounting portion which will maintain a desired retention force over a large circuit board aperture tolerance. Circuit board terminals having similar deformed mounting portions are also described in U.S. Pat. No. 3,827,004 issued to Vanden Heuvel et al. and U.S. Pat. No. 3,634,819 issued to Evans. These structures, although quite sufficient for their intended purposes, do not provide sufficient retention force without solder bonding when utilized in conjunction with wire wrap tail contacts wherein the terminal may be subjected to substantial torsional forces. Additionally, some of the prior art structures (e.g., U.S. Pat. No. 3,634,819) designed for high force retention do not sufficiently insure accurate location of the central axis of the mounting portion within the circuit board aperture upon termination.

Press fit terminals with spring arm contacts are often used in edgecard connectors. Unfortunately, such connectors built to provide high normal forces have been associated with undesirably high insertion forces, as most of them utilize cantilever spring arm systems. In order to provide satisfactory mating between the board and spring arms, a sufficient normal force must be created to assure firm electrical contact, but high board insertion forces must be avoided. The typical edgecard connector contains parallel opposing rows of terminals having spring arm contacts biased toward each other so as to define a convex contact engaging surface for a mating board. The spring arms function as cantilever beams, so that when a board is slidably inserted therebetween, the ends of the spring arms are forced laterally apart. Thus, the higher the normal force provided, the greater the insertion force. Various structures have been proposed for achieving a reduced insertion force per a given normal force, but many do so only marginally, and most involve the technique of preloading the opposing spring arm contacts as disclosed in U.S. Pat. No. 3,963,293 issued to McKee and U.S. Pat. No. 3,671,917 issued to Ammon et al.

DISCLOSURE OF THE INVENTION

The elongate press fit terminal of this invention has a mounting portion which provides a high retention force under torsional stress without solder bonding. The mounting portion also provides accurate central axis location in a circuit board aperture. The edgecard connector of this invention provides a high normal force with proportionally less insertion force than realized in cantilever systems.

The terminal mounting portion is a generally cylindrical body with symmetrically opposed oval shaped voids formed in the longitudinal dimension of the body. The cross-section is generally bow-tie shaped with symmetrically opposed dish-shaped impressions formed therein to define a reduced center portion.

The edgecard connector contains a plurality of elongated terminals having contacts at both ends and which have the above-mentioned mounting portion between the contacts. One of the contacts is a wire wrap tail; the other is a spring arm having a free end parallel to but offset from the axis of the tail. The terminals are press-fit into apertures in a supporting circuit board in parallel opposing rows. An insulative housing is fit over the spring arm contacts and is mated with the supporting circuit board. The housing contains an opening adapted for removably receiving, in edgewise fashion, a mating circuit board for electrical connection between the board and the spring arm contacts. The housing has an inner wall which restricts the free ends of the spring arms to movement only in planes parallel to the axes of the wire wrap tails of inserted terminals when a mating board is inserted into the connector.

BRIEF DESCRIPTION OF THE DRAWINGS

For better understanding of the advantages of the present invention, reference will be made to the accompanying drawings in which.

DESCRIPTION OF THE INVENTION

Figure 2:
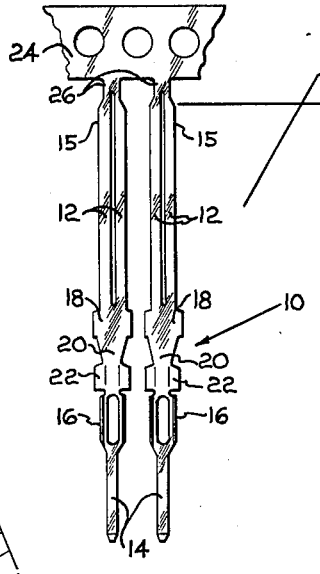
FIG. 2 is a front elevation view of the press-fit terminal of FIG. 1, including two such terminals attached to a carrier strip.
Figure 1:
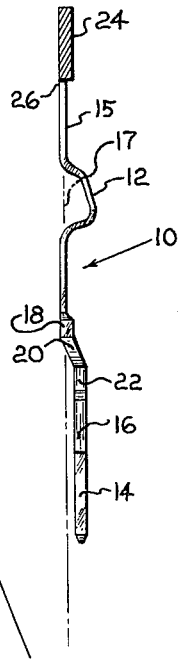
FIG. 1 is a side elevation view of a pressfit terminal of this invention attached to a carrier strip.

The elongated terminal 10 of this invention is shown in FIGS. 1 and 2. The terminal has a bifurcated spring arm contact 12 at one end and a wire wrap tail contact 14 at the other. Intermediate the contacts is a deformable mounting portion 16 adapted for press fitting into apertures in a printed circuit board. Intermediate the spring arm contact and the mounting portion is a first shoulder 18, a neck 20, and a second shoulder 22. The terminal 10 is integrally attached to a carrier strip 24 from which it is severed at reduced section 26 for press fitting into a circuit board aperture. The spring arm contact 12 when severed from a carrier strip has a free end 15 parallel to and offset from the axis 17 of the wire wrap tail 14 as may be observed in FIG. 1. The offset feature, however, is not essential to the operability of this invention.

Figure 3:
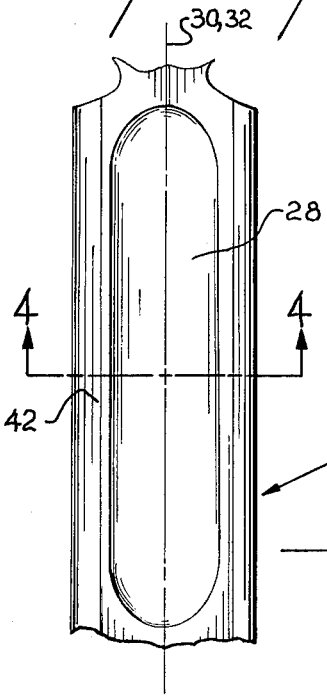
FIG. 3 is a front elevation view of the deformed mounting portion of the terminal of this invention.
Figure 4:
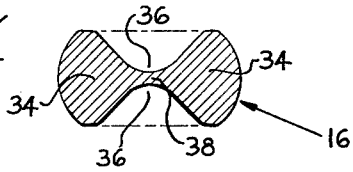
FIG. 4 is a cross-section view of the deformed mounting portion of the terminal.
Figure 5:
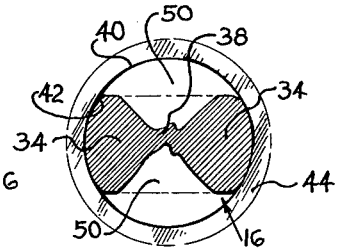
FIG. 5 is a cross-section view of one deformed mounting portion after being press-fit into a circuit board aperture.
Figure 10:
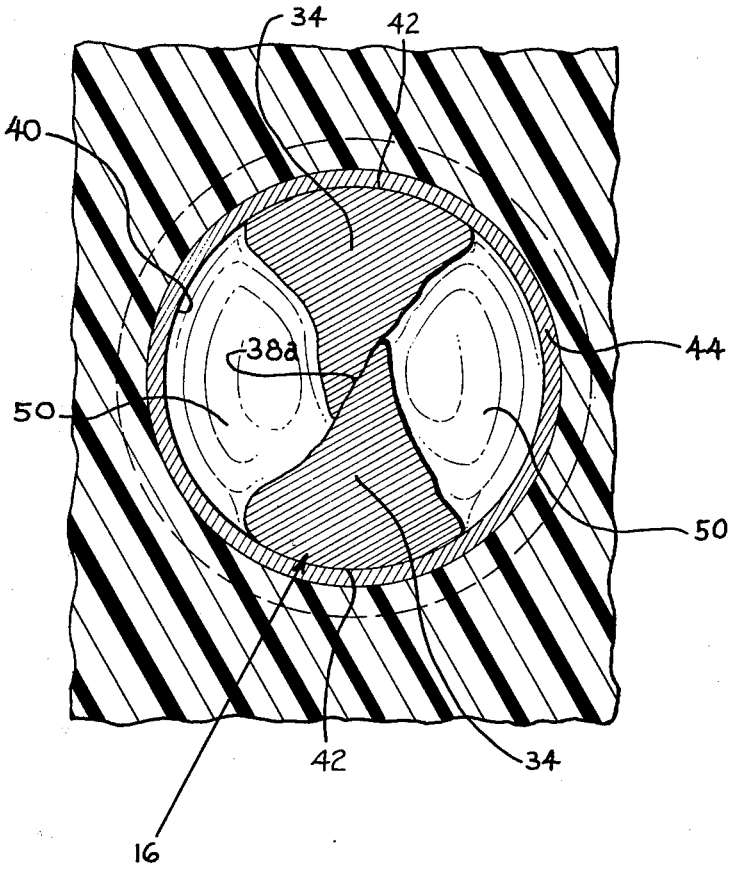
FIG. 10 is a cross-section of one deformed mounting portion after being press-fit into a circuit board aperture.

FIG. 3 is an enlarged view of the mounting portion 16 of the terminal 10. The body of the mounting portion 16 is generally cylindrical with symmetrically opposed oval-shaped voids 28 impressed therein by a die. The major axes 30 of the oval voids extend parallel to the longitudinal axis 32 of the mounting portion 16. The cross section 34 of the mounting portion 16 is shown in FIG. 4. It is generally bow-tied shaped with symmetrically opposed dish-shaped sections 36 impressed therein to form a reduced center portion 38 or 38*a*. The reduced center portion 38 or 38*a* is designed to plastically deform upon the press fitting of the mounting portion 16 into a circuit board aperture 40 as shown in FIGS. 5 and 10. Deformation of the center portion 38 or 38*a* occurs prior to the realization of injurious pressure fitting forces. Thus, referring to FIG. 5, the pressure exerted by the contact surface 42 of the mounting portion 16 against the metallization plating 44 in the aperture is thereby controlled to avoid (1) injury to the plating 44, and (2) extreme deformation of the aperture 40. At the same time, the contact surface 42 is large enough to afford high rates of retention force without solder bonding in terminations subjected to substantial torsional forces as, for example, those encountered in the use of wire wrap tails. In FIG. 10 the same effect is shown on the inner surface 40 of the circuit board aperture. However, deformation in this instance involves a distinct fracture of the center portion 38*a* of the bow-tie. There does not appear to be any significant effect on the retention forces caused by an actual fracture in 38*a*.

Figure 6:
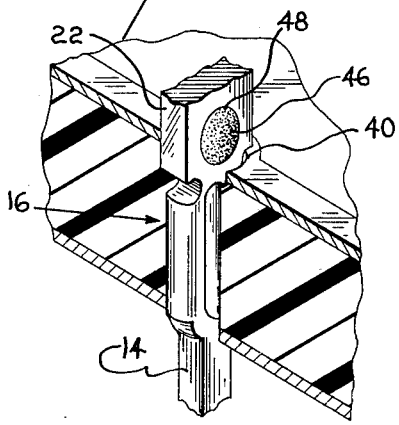
FIG. 6 is a broken perspective view of an alternate embodiment of the mounting portion of this invention.

Although, the mounting portion of this invention provides a high retention force without solder bonding, the application of solder may be utilized for an even higher retention force. Thus, FIG. 6 is a broken perspective view of an alternate embodiment of the mounting portion 16 in a cross section of the aperture 40. A mass of solder 46, shown as a globule, is contained within a support hole 48 formed within the shoulder 22 of the terminal. As the shoulder 22 is contiguous with the mounting portion 16, the mass of solder is positioned so as to flow into interspaces 50 (FIG. 5) between inserted mounting portion 16 and the aperture 40 upon exposure to an external heat source, such as infrared heater.

Figure 7:
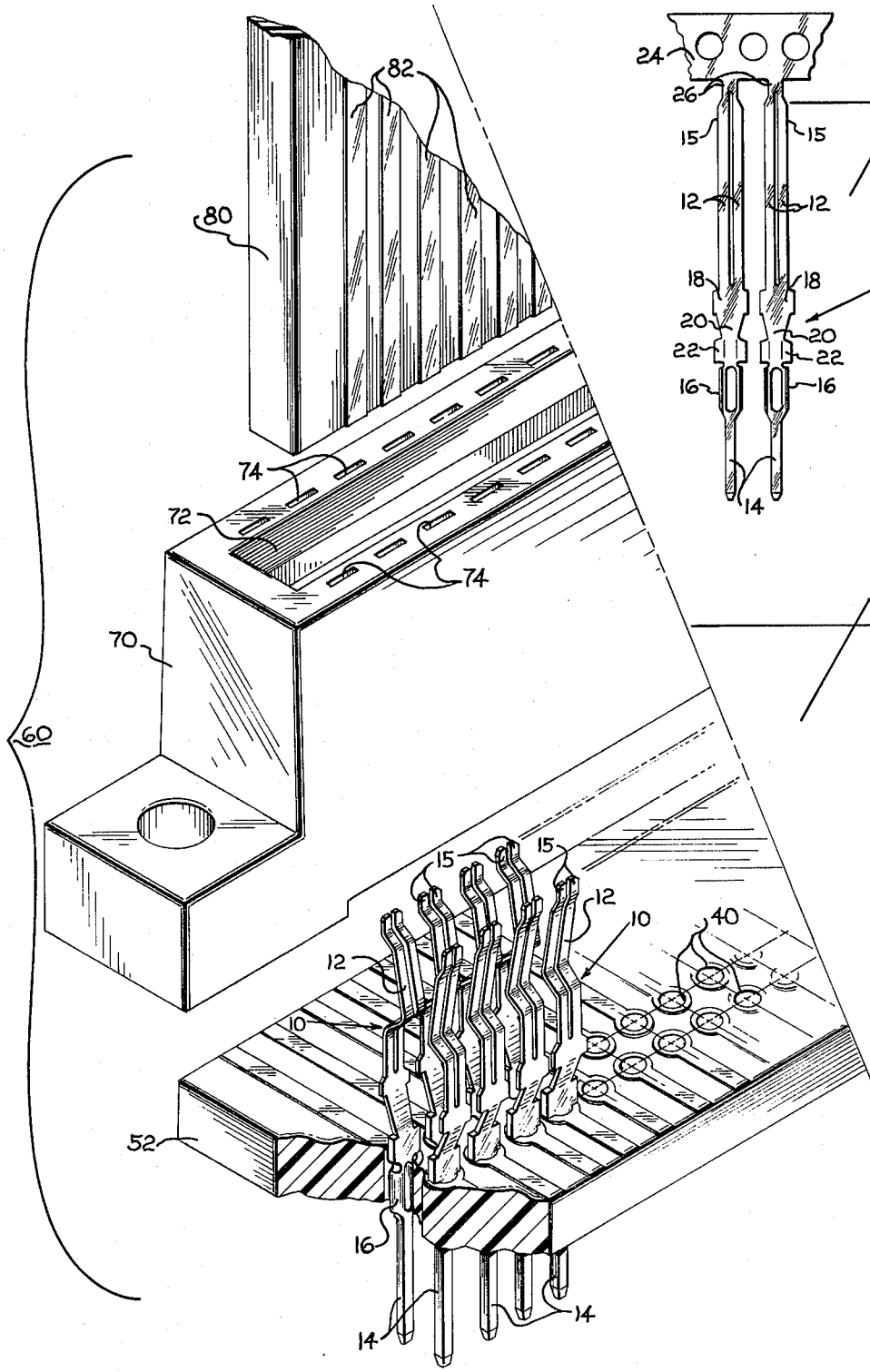
FIG. 7 is an exploded perspective view of the edgecard connector of this invention which utilizes the terminal of FIGS. 1 and 2.
Figure 8:
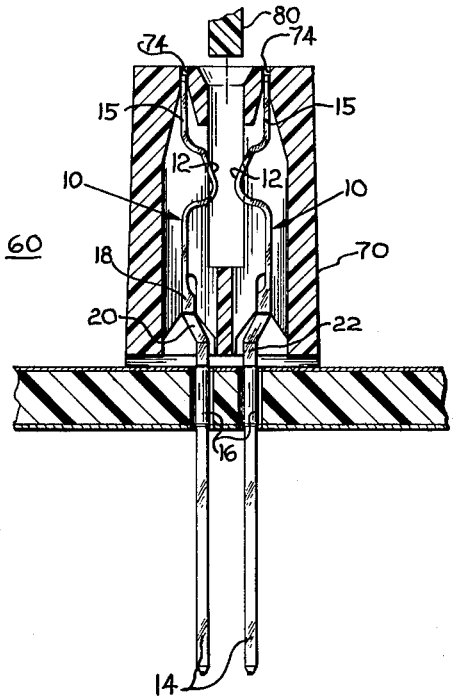
FIG. 8 is a side elevation sectional view of the edgecard connector of this invention which shows a pair of opposed terminals positioned therein.

The elongated terminal 10 of this invention is adapted for use in an edgecard connector 60 as shown in FIGS. 7 and 8.

FIG. 7 is an exploded perspective view of the connector 60 which contains a plurality of the terminals 10. The terminals are press fit into apertures 40 in a supporting circuit board 52 in opposing parallel rows as shown. An insulative housing 70 fits over the spring arm contacts 12 of the terminals 10 and is mated with the supporting board 52 by mechanical fasteners not shown. The housing 70 has an opening 72 adapted for removably receiving a mating circuit board 80 in edgewise fashion as depicted.

The circuit board 80 has metallization pads 82 printed thereon by conventional screen printing techniques. The pads 82 are electrically connected to other electrical elements, not shown. The edgecard connector 60 provides a mechanism by which mechanical and electrical contact may be achieved between the metallization pads 82 and the spring arm contacts 12 contained within the housing 70.

FIG. 8 is an elevation sectional view of the assembled edgecard connector 60 which shows a pair of opposed terminals 10 positioned within the housing 70 for receiving mating circuit board 80. The housing 70 has an internal wall 74 parallel to the axes 17 of the wire wrap tails 14 of inserted terminals 10.

Figure 9:
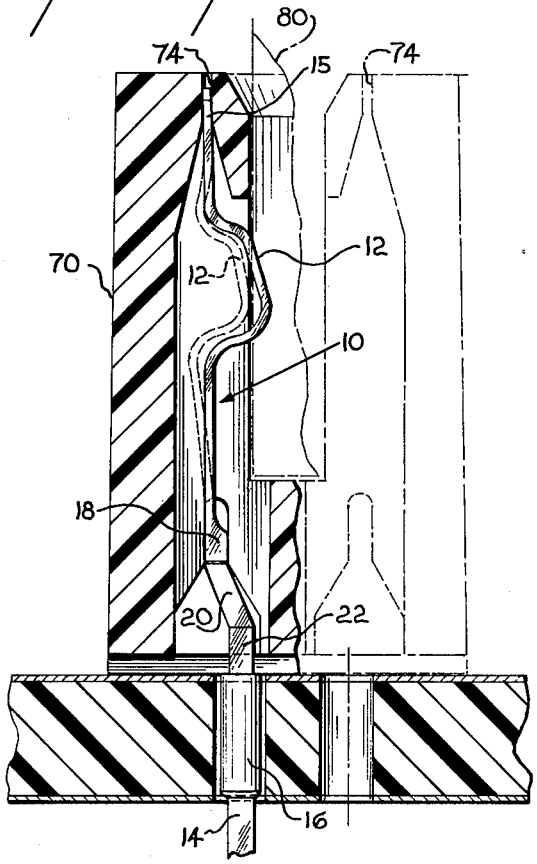
FIG. 9 is a side elevation sectional view of the connector which depicts flexure positions of the spring arm contact of the terminal of this invention.

In FIG. 9, one of the spring arms 12 is shown in both unflexed and flexed positions (the latter in phantom). The free end 15 of the spring arm 12 maintains contact with the wall 74 in both positions shown as well as between positions. The wall restricts the free end 15 to slidable movement along a plane parallel to the axis 17 of the wire wrap tail 14 of an inserted terminal 10. The spring arm 12 functions therefore as a leaf spring instead of the typical cantilever spring used in most edgecard connectors. Thus, as seen in FIG. 8, since the free ends 15 of the spring arms 12 cannot move laterally, they will not be forced apart upon insertion of a mating board so as to produce the high rates of insertion forces associated with cantilever systems. Rather, a much lower insertion force is realized for a given normal force value in the leaf spring system of this invention.

Industrial Applicability

The press fit terminal and edgecard connector of this invention have wide applicability in microcircuits applications involving electrical terminations between circuit boards. For example, such devices are mounted in electronic backplanes of computers, telephonic switching gear, and many other low voltage signal systems.

Having thus described the best mode of the invention, making reference to certain specific embodiments thereof, the appended claims are intended to cover such modifications as may fall within their scope.

What I claim is:

1. An elongated electrical terminal having a contact at each end and a deformable mounting portion therebetween, said mounting portion comprising:

a generally cylindrical body having symmetrically opposed generally oval-shaped voids impressed therein, the major axes of said oval voids extending parallel to the longitudinal axis of said body, the body having a generally bow-tie shaped cross section with convex surfaces at its ends and symmetrically-opposed, dish-shaped impressions formed in its sides to define a reduced center portion in said cross section, said mounting portion upon press fitting into a round circuit board aperture having the convex surfaces at each end of the bow-tied shaped cross section in intimate contact with the inside surface of said round aperture and said reduced center being plastically deformed.

2. The terminal of claim 1 wherein said terminal further comprises one of said contacts being a spring arm having a free end parallel to said longitudinal axis of the terminal.

3. The terminal of claim 1 wherein said terminal further comprises a mass of solder adjacent the mounting portion, said mass of solder being positioned so as to flow, upon exposure to an external heat source, into interspaces between an inserted mounting portion and a corresponding circuit board aperture.

4. The terminal of claim 1 wherein said terminal further comprises one of said contacts being a wire wrap tail, the other being a spring arm having a free end parallel to and offset from the axis of the wire wrap tail.

5. The terminal of claim 4 further comprising a bifurcated spring arm contact, said terminal having a first shoulder, a neck portion, and a second shoulder, all positioned intermediate said spring arm contact and mounting portion.

6. An edgecard connector which comprises:

(a) a plurality of elongated terminals having contacts at both ends and a deformable mounting portion therebetween, said mounting portions being press fit into apertures in a supporting circuit board, one of said contacts being a spring arm having a free end, said mounting portion having a generally cylindrical body with symmetrically opposed generally oval-shaped voids impressed therein, the major axes of said oval voids extending parallel to the longitudinal axis of said body, the body having a generally bow-tie shaped cross section with convex surfaces at its ends and symmetrically-opposed, dish-shaped impressions formed in its sides to define a reduced center portion in said cross section, said mounting portion upon press fitting into a round circuit board aperture having the convex surfaces at each end of the bow-tied shaped cross section in intimate contact with the inside surface of said round aperture and said reduced center being plastically deformed, (b) an insulative housing mated with said supporting circuit board, said housing having means to removably receive, edgewise, a mating circuit board, and adapted to fit over the spring arm contacts of said plurality of terminals, the terminals being positioned in opposing rows in said apertures of the supporting circuit board, the housing having a wall therein substantially parallel to the axes of the wire wrap tails of inserted terminals, the wall being adapted to restrict the free ends of the spring arms to movement only along a plane parallel to the axes of said tails when a mating circuit board is inserted into the connector.

7. The edgecard connector of claim 6 further comprising the mating of said insulative housing with said supporting circuit board by mechanical fastener means.

8. The edgecard connector of claim 7 further comprising a bifurcated spring arm contact on said terminal, the terminal having a first shoulder, a neck, and a second shoulder, all positioned intermediate said spring arm contact and mounting portion.

* * * * *